United States Patent [19]

Kolin

[11] 4,444,011

[45] Apr. 24, 1984

[54] HOT GAS ENGINE

[75] Inventor: Ivo Kolin, Zagreb, Yugoslavia

[73] Assignee: Grace Dudley, Lausanne, Switzerland

[21] Appl. No.: 251,918

[22] Filed: Apr. 7, 1981

[30] Foreign Application Priority Data

Apr. 11, 1980 [YU] Yugoslavia ..... 1009/80

[51] Int. Cl.[3] ..... F02G 1/04

[52] U.S. Cl. ..... 60/517; 60/526

[58] Field of Search ..... 60/508, 509, 512, 516, 60/517, 518, 519, 520, 525, 526

[56] References Cited

U.S. PATENT DOCUMENTS

| | | | |
|---|---|---|---|
| 2,508,315 | 5/1950 | Van Weenen et al. | 60/518 |
| 3,802,196 | 4/1974 | Franklin | 60/519 |
| 4,020,635 | 5/1977 | Joynes et al. . | |
| 4,103,491 | 8/1978 | Ishizaki . | |
| 4,107,925 | 8/1978 | Watson . | |
| 4,136,523 | 1/1979 | Pronovost . | |
| 4,161,866 | 7/1979 | Kamiyama . | |
| 4,183,214 | 1/1980 | Beale et al. . | |
| 4,195,482 | 4/1980 | Moloney . | |
| 4,199,945 | 4/1980 | Finkelstein . | |
| 4,228,656 | 10/1980 | Frosch | 60/518 |
| 4,236,383 | 12/1980 | Selcuk . | |

OTHER PUBLICATIONS

"The Evolution of the Heat Engine", by Ivo Kolin, copyrighted 1972, by Longman Group Limited, London, pp. 16, 17, 18, 19, 20, 22, 55, 57, 64, 69 and 78.

"Heat and Heat-Engines", by Frederick Remsen Hutton, copyrighted 1899 by John Wiley & Sons, New York, New York.

"Thermodynamics for Chemical Engineers", by Harold C. Weber, copyrighted 1939 by John Wiley & Sons, Inc., New York, New York.

"Solar Stirling Engine", by E. F. Lindsley, Popular Science, Jun. 1978, pp. 74, 75, 76 and 77.

*Primary Examiner*—Allen M. Ostrager

*Attorney, Agent, or Firm*—Brumbaugh, Graves, Donohue & Raymond

[57] ABSTRACT

A hot gas engine has an elastic and a lost motion connection between the working piston and the displacer, resulting in a rapid shifting of the displacer between its extreme positions. The hot and cold walls between which the displacer reciprocates are substantially planar and parallel, and the displacer is in the shape of a plate. The working piston comprises a diaphragm, so that there is no loss of working gas from the motor chamber.

14 Claims, 3 Drawing Figures

HOT GAS ENGINE

BACKGROUND OF THE INVENTION

The present invention relates to hot gas engines, sometimes referred to as Stirling engines.

The hot gas engine introduced by Stirling comprises a long metal cylinder, which is heated at one end by flames and cooled at the other end by a water jacket. A displacer piston is disposed within the metal cylinder, which communicates with a working cylinder in which reciprocates a working piston. The displacer piston and the working piston are rigidly or directly connected together so as to remain approximately 90° out of phase.

The working gas is predominantly compressed in the cold space and expands mostly from the hot space. Inasmuch as the expansion of the hot gas produces more energy than is consumed by the compression of the cold gas, the difference constitutes the available engine power, which is obtained from the working piston.

The principles of hot gas engines are well known and need not be discussed here in detail. Reference may be had to the following U.S. patents, which are incorporated herein by reference:

| | |
|---|---|
| 4,020,635 | 4,183,214 |
| 4,103,491 | 4,195,482 |
| 4,107,925 | 4,199,945 |
| 4,136,523 | 4,236,383 |
| 4,161,866 | |

SUMMARY OF THE INVENTION

In accordance with the invention, a hot gas engine is provided in which there is an elastic and a lost motion connection between the working piston and the displacer, resulting in a rapid shifting of the displacer between the hot and cold sides of the housing in which the displacer reciprocates. As a result, the working gas is alternately hotter and colder than is the case in conventional hot gas engines, and so an increased engine output is obtained.

The heated and cooled walls between which the displacer reciprocates are substantially planar and parallel to each other, and the displacer is in the shape of a plate. The spacing between the hot and cold walls is relatively small, resulting in relatively large hot and cold surface areas and thus a relatively large power output from a relatively small engine.

There are no running seals and therefore no escape of working gas. The power piston comprises a diaphragm that is displaced or expanded by the expansion of the working gas. The coupling between the displacer and the power piston includes a rotatable shaft extending through the housing wall that is sealed by an elastomeric sleeve secured at one end to the shaft and at the other to the housing wall.

BRIEF DESCRIPTION OF THE DRAWINGS

The foregoing and other features of the invention will be more readily apparent from the following description of exemplary embodiments in conjunction with the accompanying drawings, in which.

DESCRIPTION OF THE PREFERRED EMBODIMENTS

Figure 1:
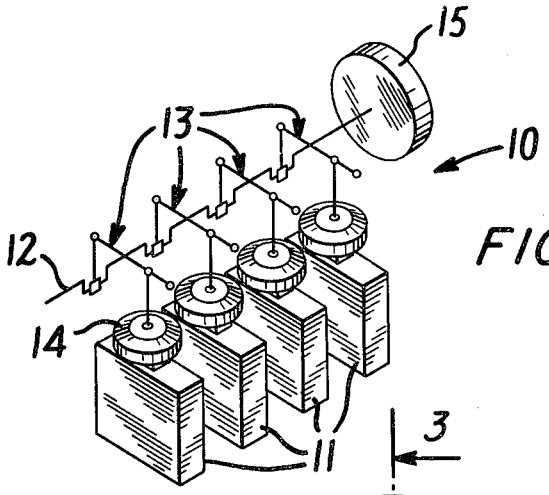
FIG. 1 is a simplified schematic view in perspective of a hot gas engine in accordance with the invention.

A brief description of a simplified representative embodiment of the invention may be had in conjunction with FIG. 1. The hot gas engine 10 includes a plurality of housings 11, to each of which a heating medium and a coolant (not shown) are supplied so as to expand and contract a gas (not shown) in each housing and thereby driving a crankshaft 12 through a respective linkage 13. The gas in each housing 11 displaces a respective diaphragm 14 to which the respective linkage 13 is connected.

The crankshaft 12 in turn rotates a flywheel 15, and the output of the engine 10 may be obtained from the crankshaft 12 or the flywheel 15. The engine output may be used to drive an electrical generator, a hydraulic or heat pump, etc.

Figure 2:
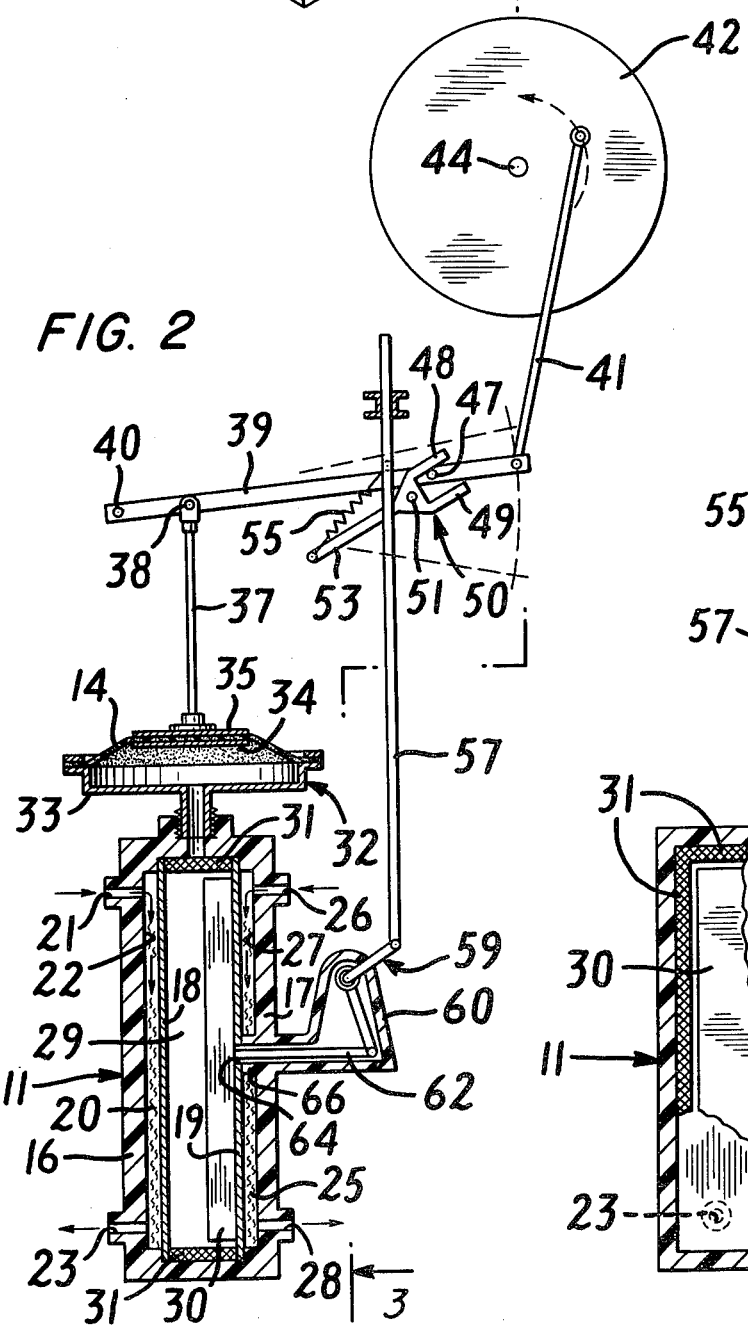
FIG. 2 is a view, partially in section, of a single cell hot gas engine according to the invention.
Figure 3:
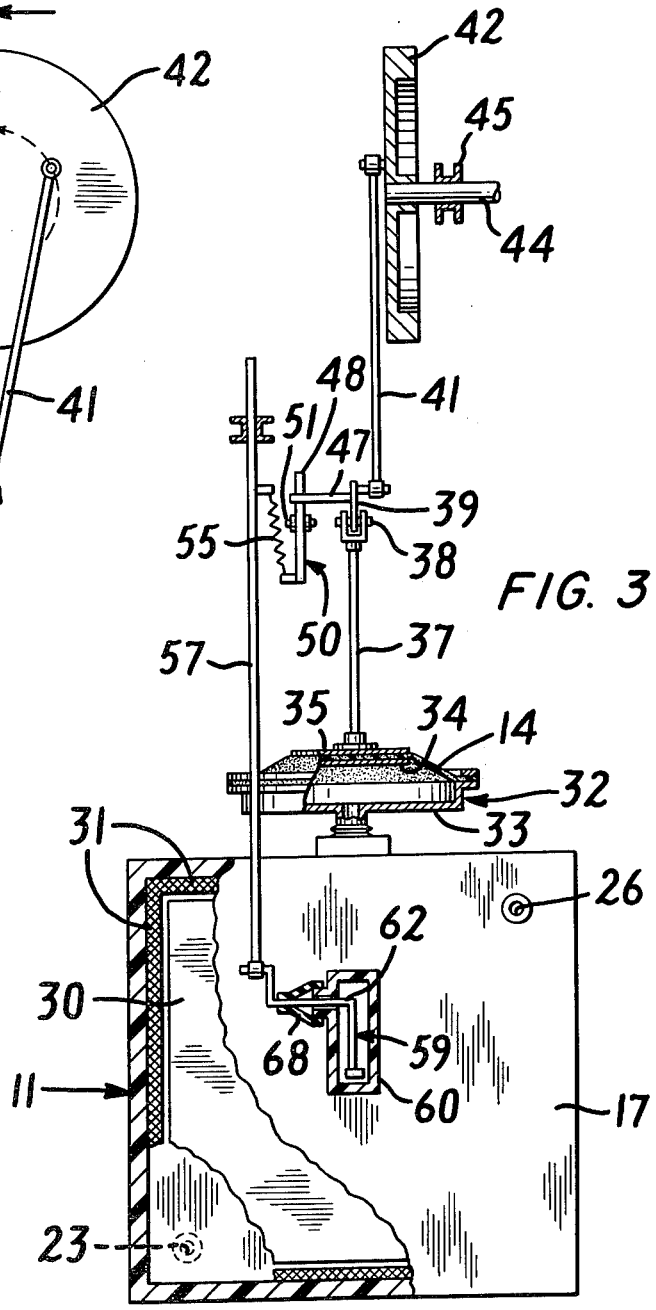
FIG. 3 is a view, partly broken away, taken along the line 3—3 of FIG. 2 and looking in the direction of the arrows.

FIGS. 2 and 3 show the hot gas engine according to the invention in greater detail, shown for simplicity as a single cell engine. The housing 11 is of generally rectangular, thin shape, and is of a suitable heat-insulating material, preferably a plastic.

Spaced inwardly of and substantially parallel to the housing side walls 16 and 17 are heat-conducting walls 18 and 19, respectively, which are preferably of metal. The metal wall 18 is heated by a heating medium 20, which is supplied from a source (not shown) through an inlet port 21 to a narrow chamber 22 formed between the housing wall 16 and the metal wall 18. The heating medium 20 is discharged from the chamber 22 through a port 23 and may be recirculated so as to be reheated by the heat source.

While combustion gases from petroleum derivatives, alcohol, biowaste etc. may be supplied to the chamber 22, the invention lends itself to the use of a heated liquid which is frequently available as waste heat. Alternatively hot water from geothermal springs, solar collectors, or shallow reservoirs may be recirculated through chamber 22. Similarly, a hot oil at elevated temperature or a liquid metal, as in an atomic reactor, may be used for the heating medium 20.

Such recirculation is advantageous in that only the heat actually removed from the medium 20 in the housing 11 needs to be replaced; the unused heat is returned to the reservoir (not shown). Preferably such reservoir and the conduits communicating it with the ports 21 and 23 are insulated.

The metal wall 19 is cooled by a coolant 25, which is supplied from a source (not shown) through an inlet port 26 to a narrow chamber 27 formed between the housing wall 17 and the metal wall 19. The coolant 25 is discharged from the chamber 27 through a port 28 and may be recirculated through a refrigerating means (not shown), although the coolant is preferably obtained naturally, for example from river water, and simply discharged through the port 28 or used where such a heated fluid is required or beneficial.

Mounted for reciprocation between the metal walls 18 and 19 in the chamber 29 defined thereby is a displacer plate 30, which is of a suitable heat-insulating material such as a plastic. The plate 30 is shown against the cold wall 19 in FIG. 2.

As is typical with hot gas engines, there is a gap or flow transfer space between the periphery of the displacer 30 and the adjacent walls of the housing 11, so that the working gas within the housing 11 may flow from one side of the displacer to the other. A regenerator 31 is disposed in the flow transfer space and is preferably composed of dense wire netting.

The working gas may be air or an inert gas such as Freon or helium or any other fluid having similar thermal properties.

The flow transfer space communicates with a diaphragm motor 32 comprising a rigid housing 33 closed by the diaphragm 14, which may be an elastic membrane and the periphery of which is secured in sealing relation to the periphery of the housing 33. The center of the diaphragm 14 is reinforced by two plates 34 and 35, which are secured to and drive the piston rod 37 of the motor 32.

The piston rod 37 is pivotally connected at 38 to a lever 39 intermediate its ends and near to the fulcrum 40 about which the lever is swung or reciprocated by the piston rod. The other end of the lever 39 is pivotally connected to a connecting rod 41, which in turn is pivotally connected to a flywheel 42, so that reciprocation of the piston rod 37 rotates the flywheel and the output shaft 44 on which the flywheel is mounted.

The output shaft 44 is mounted for rotation in a suitable bearing 45 and is connected to the load (not shown) to be driven by the hot gas engine, which might be an electrical generator, irrigation pump, heat pump or similar equipment.

Mounted on the lever 39 between the pivot 38 and the lever end connected to the connecting rod 41 is a pin 47 that extends laterally of the lever 39. The pin 47 extends between a pair of spaced prongs 48 and 49 at one end of a fork 50, which is mounted for rotation about a fulcrum 51. The other end 53 of the fork 50 is connected to one end of a spring 55, the other end of the spring being connected to a push rod 57, which is mounted for reciprocation.

The end of the push rod 57 remote from the spring 55 is pivotally connected to one end or arm of a crank 59 that is accommodated in an outward extension 60 of the housing side wall 17. The central shaft portion 62 of the crank 59 extends through and is journaled for rotation in a wall of the housing extension 60. The other end or arm of the crank 59 is disposed within the extension 60 and is pivotally connected to one end of a rod 62, the other end of which is connected to the displacer plate 30.

Accordingly, one cycle of reciprocation of the push rod 57 drives the displacer plate 30 from its position against the cold wall 19 shown in FIG. 2 to the hot wall 18, and thereafter returns the displacer to the cold wall.

The rod 62 extends through an aperture 64 in the cold wall 19. An inward extension 66 of the housing side wall 17 is sealingly secured to the cold wall 19 adjacent the aperture 64, so that the working gas may enter the housing extension 60 but not the coolant chamber 27. Similarly, the coolant in the chamber 27 is prevented from entering the chamber 29 and the extension 60.

An elastomeric sleeve 68 sealingly engages the housing extension 60 and the crank 59, permitting rotation of the crank while preventing any escape of working gas from the housing extension.

The basic operation of the hot gas engine according to the invention is the same as that of a conventional hot gas engine in that the expansion of the heated working gas drives the piston rod 37 upwardly as viewed in FIGS. 2 and 3, and the displacer 30, which is coupled to the piston rod, is thereafter driven to the hot wall 18 to enable the cold wall 19 to cool the working gas, contract the diaphragm 14 and drive the piston rod downwardly. Similarly, the regenerator 31 absorbs heat from the working gas when it flows into the space between the displacer 30 and the cold wall 19, and returns heat to the gas when it flows away from the space adjacent the cold wall.

In a conventional hot gas engine there is a rigid or direct connection between the working piston and the displacer in order to maintain a phase difference of approximately 90° therebetween. In the present invention, however, there is an elastic and a lost motion connection between the working piston and the displacer. The lost motion action is provided by the pin 47 acting alternately against the spaced prongs 48 and 49, and the elastic connection is provided by the spring 55.

This novel coupling biases the displacer plate 30 in one of two positions—against the hot wall 18 or against the cold wall 19, and causes a rapid shifting of the displacer plate between these two positions. Referring to FIG. 2, the diaphragm 14 continues to be displaced upwardly by the heated expanding working gas, driving upwardly the lever 39 and the pin 47. This rotates the fork 50 in the counterclockwise direction, thus stretching the spring 55 until at the end of the stroke the spring suddenly drives the push rod 57 downwardly, shifting the displacer 30 against the hot wall 18.

When the lever 39 and the pin 47 are pulled downwardly as the working gas contracts, the fork 50 is rotated in the clockwise direction and stretches the spring 55 until at the end of the downward stroke the spring suddenly drives the push rod 57 upwardly, shifting the displacer 30 against the cold wall 19.

Due to the rapid transfer of the working gas, the expansion of the entire mass of exclusively hot gas provides a larger work output and the compression of exclusively cold gas requires less work than would a conventional hot gas engine. This is because of the direct connection between the working piston and the displacer in the conventional engine, wherein heating and cooling of the working gas occur simultaneously, resulting in a mixture of hot and cold gases. This means that the working gas in the conventional engine remains in a lukewarm range, instead of being alternately as hot and cold as in the present engine.

As a result, in the conventional gas engine it is impossible to achieve a thermodynamically pure isothermal situation in which the entire working gas is either hot or cold. Thus the expansion of the mixture of hot and cold gases performs less work than would be achieved with an exclusively hot gas, and the compression of the cold-hot mixture consumes more work than would be necessary with an exclusively cold gas. Accordingly, the difference which is available as useful work is decreased.

The increased work output provided by the hotter gas in the present engine together with the decreased consumption of work during compression of the colder gas results in a greater difference, and thus an increased engine output.

Because of the increased output of the engine according to the invention, it lends itself to the exploitation of heat sources of lower temperatures, even below 100° C. Such heat sources are widely available in nature, such as geothermal springs or hot water from solar collectors. For such an application the engine would be larger, since the engine output is proportional to the working temperature. Thus, the individual cells would be larger, and/or a greater number of cells could be used. Conversely, engines operating at high temperatures may be constructed much smaller.

Another advantage of the present engine is its simple construction, in that there are no parts which must be constructed with high precision tolerances. The plastic housings 11 may be produced more easily and cheaply than the metal cylinders of conventional hot gas engines. In addition, the use of heat-insulating materials for the housing 11 and the displacer plate 30 reduces the heat losses in comparison with the metal cylinders of conventional engines, in which heat is lost through conduction to the cold side and withdrawn by the coolant.

The housings 11 according to the invention are relatively thin, that is the spacing between the hot wall 18 and cold wall 19, between which the displacer 30 reciprocates, is relatively small. This provides a substantial increase in the surface areas of the hot and cold surfaces in comparison with the long cylinders of conventional hot gas engines, in which the transfer of heat occurs at the inner cylindrical surface. Accordingly the present hot gas engine, comprising a plurality of cells (each including a housing 11), has much larger hot and cold total surface areas than does a conventional engine of the same overall size, and thus the present engine generates greater power.

Also, the relatively narrow heating chamber 22 and coolant chamber 27 insure an excellent transfer of heat to and from the working gas, especially when liquids are used for the heating medium and the coolant.

There is no escape of working gas from either the housing 11 or the motor 32, because running seals are avoided. The working piston comprises the diaphragm 14 and there is no sliding connection to the housing 33, in contrast with the working piston/cylinder arrangement of conventional hot gas engines. The rotatable shaft 62 extending through the wall of the housing extension 60 is securely sealed thereto by the elastomeric sleeve 68.

Although the invention has been described with reference to specific embodiments thereof, many modifications and variations may be made by one skilled in the art without departing from the inventive concepts disclosed. For example, the housing 11, displacer plate 30 and regenerator 31 may be of circular shape as viewed in FIG. 3. All such variations and modifications, therefore, are intended to be included within the spirit and scope of the appended claims.

I claim:

1. A hot gas engine comprising:

means forming a chamber for containing a working gas, displacer means disposed for reciprocation between two maximum displacement positions in the chamber forming means, working piston means mounted for reciprocation and exposed to the working gas, and means coupling the displacer means with the working piston means for rapidly shifting the displacer means between the two maximum displacement positions, the coupling means including elastic means and biasing the displacer means towards its two positions of maximum displacement.

2. A hot gas engine comprising:

means forming a chamber for containing a working gas, displacer means disposed for reciprocation between two maximum displacement positions in the chamber forming means, working piston means mounted for reciprocation and exposed to the working gas, means coupling the displacer means with the working piston means for rapidly shifting the displacer means between the two maximum displacement positions, means for supplying a heating medium to one portion of the chamber forming means, and means for supplying coolant to another portion of the chamber forming means, the displacer means being disposed for reciprocation between the heated portion and the cooled portion of the chamber forming means.

3. A hot gas engine comprising:

means forming a chamber for containing a working gas, displacer means disposed for reciprocation between two maximum displacement positions in the chamber forming means, working piston means mounted for reciprocation and exposed to the working gas, and means coupling the displacer means with the working piston means for rapidly shifting the displacer means between the two maximum displacement positions, the chamber forming means and the displacer means being formed of a heat-insulating material.

4. The hot gas engine according to claim 1 in which the coupling means also includes lost motion means.

5. A hot gas engine comprising:

means forming a chamber for containing a working gas, displacer means disposed for reciprocation between two maximum displacement positions in the chamber forming means, working piston means mounted for reciprocation and exposed to the working gas, means coupling the displacer means with the working piston means for rapidly shifting the displacer means between the two maximum displacement positions, and regenerator means disposed in the chamber forming means adjacent the periphery of the displacer means.

6. A hot gas engine comprising:

means forming a chamber for containing a working gas, a first portion of the chamber forming means being substantially planar, means for supplying a heating medium to the first planar chamber portion, a second portion of the chamber forming means being substantially planar and parallel to and spaced from the first planar chamber portion, means for supplying a coolant to the second planar chamber portion, a displacer plate disposed for reciprocation between the first and second planar chamber portions and substantially parallel thereto, a dimension of the displacer plate perpendicular to the direction of reciprocation being large in comparison with the spacing between the first and second planar chamber portions, working piston means mounted for reciprocation and exposed to the working gas, and means for coupling the displacer means with the working piston means.

7. The hot gas engine according to claim 6 in which the working piston means includes diaphragm means mounted at its periphery in sealing relation to the chamber forming means.

8. The hot gas engine according to claim 6 in which the coupling means includes a member extending through the chamber forming means and displaceable with respect thereto, and also including elastomeric sleeve means sealingly secured to the member and the chamber forming means.

9. The hot gas engine according to claim 6 in which the heating medium and the coolant are liquids.

10. The hot gas engine according to claim 6 in which the heating medium and the coolant are fluids.

11. The hot gas engine according to claim 4 in which the lost motion means includes a pin connected to the working piston means and disposed between spaced engagement elements at one end of a lever that is pivotally mounted intermediate its ends, and the elastic means couples the opposite end of the lever with the displacer means.

12. A hot gas engine comprising:

means forming a chamber for containing a working gas, displacer means disposed for reciprocation between two maximum displacement positions in the chamber forming means, working piston means mounted for reciprocation and exposed to the working gas, and means for coupling the displacer means with the working piston means so that the displacer means remains in the two maximum displacement positions during most of each operating cycle.

13. The hot gas engine according to claim 12 in which the coupling means includes elastic means and biases the displacer means towards its two positions of maximum displacement.

14. The hot gas engine according to claim 13 in which the coupling means also includes lost motion means.

* * * * *